US009543690B2

(12) United States Patent
Broughton

(10) Patent No.: US 9,543,690 B2
(45) Date of Patent: Jan. 10, 2017

(54) MINERALLY INSULATED CABLE CONNECTOR

(71) Applicant: ROLLS-ROYCE plc, London (GB)

(72) Inventor: Paul Broughton, Leicester (GB)

(73) Assignee: ROLLS-ROYCE plc, London (GB)

( * ) Notice: Subject to any disclaimer, the term of this patent is extended or adjusted under 35 U.S.C. 154(b) by 0 days.

(21) Appl. No.: 14/947,235

(22) Filed: Nov. 20, 2015

(65) Prior Publication Data

US 2016/0149335 A1 May 26, 2016

(30) Foreign Application Priority Data

Nov. 26, 2014 (GB) ..... 1420990.2

(51) Int. Cl.

| | |
|---|---|
| ***H01R 13/40*** | (2006.01) |
| ***H01R 13/52*** | (2006.01) |
| ***H01R 13/533*** | (2006.01) |
| ***H01R 43/00*** | (2006.01) |
| *H01R 24/86* | (2011.01) |

(52) U.S. Cl.

CPC ..... *H01R 13/5205* (2013.01); *H01R 13/533* (2013.01); *H01R 43/005* (2013.01); *H01R 24/86* (2013.01)

(58) Field of Classification Search

CPC ... H01R 13/5205; H01R 13/533; H01R 13/52; H01R 43/005; H01R 24/86; H01R 43/00

USPC ..... 439/587; 29/876

See application file for complete search history.

(56) References Cited

U.S. PATENT DOCUMENTS 3,772,545 A * 11/1973 Hatschek ..... H01R 13/533 310/329

6,109,946 A 8/2000 Hotz et al.

FOREIGN PATENT DOCUMENTS

| | | | |
|---|---|---|---|
| CN | 202 550 095 | U | 11/2012 |
| EP | 2 610 972 | A2 | 7/2013 |
| GB | 2 138 638 | A | 10/1984 |
| GB | 2302618 | A | 1/1997 |

OTHER PUBLICATIONS

Apr. 13, 2016 Search Report issued in European Patent Application No. 15 19 5575.

Apr. 23, 2015 Search Report issued in British Patent Application No. 1420990.2.

* cited by examiner

*Primary Examiner* — Javaid Nasri

(74) *Attorney, Agent, or Firm* — Oliff PLC

(57) ABSTRACT

An electrical connector assembly for the electrical connection of one or more minerally insulated cables (11), the assembly comprising a pot seal arrangement (10) arranged in use to connect the minerally insulated cable (11) to a connector (22); at least one cable alignment plate (21, 31); and, a backshell (20) shaped so as to contain the pot seal (10) and cable alignment plate (21); the cable alignment plate (21) and pot seal (10) being arranged so as to locate within the backshell (20) such that in use, connecting the backshell (20) to the connector (22) forces the backshell (20), cable alignment plate (21) and pot seal (10) into a cooperative engagement.

15 Claims, 4 Drawing Sheets

MINERALLY INSULATED CABLE CONNECTOR

FIELD OF THE INVENTION

The present invention relates to an apparatus and method for providing an improved assembly for the electrical connection of one or more cables. In particular, it relates to an apparatus and method for connecting or terminating a minerally insulated cable whilst providing improved reliability and damage resistance.

BACKGROUND OF THE INVENTION

For high speed data bus and optical systems, a series of connectors and inserts have been recently developed. These allow the use of keyed inserts inside a standardised connector shell, wherein keyed flats ensure that inserts are correctly inserted within a connector housing.

In the case of a typical connector shaped conductors project from one side to the other and are held by an insulator mounted within a metal casing. This insulator would typically be made of epoxy, silicon rubber sealant or glass, as is the case with a standard "MIL-38999" type connector.

Most typically, wires are soldered or crimped onto the backs of pins to make a good mechanical and electrical contact. As such, the fronts of the conductors are shaped, for example, as pins which are designed to fit into sockets in a matching connector. The two connector casings (male and female) engage to ensure axial alignment via machined flats to ensure the correct angular orientation the male and female portions are matably received. Thus, through insertion of the male portion into the female portion, the pins and sockets are substantially aligned before they come into contact with each other and damage through incorrect insertion is thereby prevented, so being referred to as "scoop-proofing".

A number of connectors have been developed which allow a number of these small connectors to be assembled into a standard larger connector. Such large connector assemblies, which comprise multiple individual connectors, may also include a screw fixing to hold two halves of a connector together. Such large scale connectors usually contain further key-ways to ensure angular orientation between the two halves of said large scale connector.

Typically, minerally insulated cable, also known as MI cable, is used in high temperature applications. Therein, a flexible metal tube/casing is typically filled with one or more wires, the wires of which are often prevented from coming into contact with both each other and the casing by filling the tube with a mineral powder to provide both an electrical- and heat-insulating portion. In particular, the incorporation of a heat-insulating portion thereby makes MI cable particularly suitable for use in high-temperature environments.

Of particular difficulty when using MI cable is the connection and termination of the cable within a given electrical system. In particular, pot seals are known as a viable means for both connecting and terminating MI cable, wherein MI cable is fed into a casing, which is most typically metal and thereby referred to as a pot. However, MI cable is notoriously difficult to terminate and/or connect to other components using these methods, and these terminations are easily damaged such that they are rendered unreliable.

It would therefore be advantageous to provide an improved connector suitable for the connection or termination of MI cable without the aforementioned disadvantages.

SUMMARY OF THE INVENTION

The present invention accordingly provides, in a first aspect, an electrical connector assembly for the electrical connection of one or more minerally insulated cables, the assembly comprising a pot seal arrangement arranged in use to connect the minerally insulated cable to a connector; at least one cable alignment plate; and, a backshell shaped so as to contain the pot seal and cable alignment plate; the cable alignment plate and pot seal being arranged so as to locate within the backshell such that in use, connecting the backshell to the connector forces the backshell, cable alignment plate and pot seal into a cooperative engagement.

Thus, in this way, the present invention provides an improved means of termination or connection of MI cable, which provides improved reliability and damage resistance over connection apparatus and methods currently comprised within the art. Thus, in this way, the present invention provides a design of increased robustness and reliability through the pot seal and MI cable being positively held in to remove strain on the MI/Pot Seal junction.

Optionally, the backshell and connector may comprise attachment members arranged to attach the backshell to the connector.

Thus, in this way, the assembled backshell and connector may provide a means of encasing the electrical connection, so providing additional heat and environmental resistance, whilst preferably providing full EMC shielding. Thus, the connector backshell may clamp MI cables together, allowing cables to run as a bundle from the backshell into the connector.

Optionally, the backshell may comprise one or more cable location features.

Thus, in this way, the backshell may allow multiple cables to be fed into either single or multiple pot seals for further connection to the electrical conductor, so improving packing density of the electrical connector. Thus, in this way, each MI cable may be changed individually, if so required.

Optionally, each cable alignment plate may comprise one or more cable location features.

Optionally, the cable location features of the cable alignment plate and backshell may be aligned in use such that cable passes through the backshell and cable alignment plate.

Optionally, the cable passing through the alignment plate and backshell may be aligned according to the cable location features of the connector.

Optionally, the cable alignment plate may be comprised of a rigid material including one or more of metallic, ceramic, composite or polymeric material.

Optionally, the cable alignment plate may be comprised of a flexible material including one or more of metallic, ceramic, composite or polymeric or elastomeric material.

Optionally, at least one cable alignment plate may be comprised of a substantially flexible elastomeric or polymeric material.

Optionally, at least one cable alignment plate may be comprised of a substantially rigid elastomeric, polymeric, ceramic or metallic material.

Optionally, the slot width of the cable location features comprised within the cable alignment plate may be approximately equal to the diameter of the cable.

Optionally, the cable location features comprised within the cable alignment plate may be shaped so as to at least partially inhibit the withdrawal of the cable from the cable location feature.

Optionally, the cable location features comprised within the cable alignment plate may be shaped so as to support the cable in both a radial and axial direction.

Optionally, the pot seals may locate within shapes, recesses or protrusions within the cable alignment plate.

Optionally, the connector may comprise recesses which resist lateral and axial forces acting on the pot seals.

Optionally, the connector assembly may comprise an interfacial seal.

Optionally, the connector assembly may comprise an environmental seal.

The present invention accordingly provides, in a second aspect, a method of electrically connecting a minerally insulated cable, the method comprising the steps of passing at least one cable through a backshell; passing said cable through an alignment plate; matably receiving said cable within a pot seal arrangement; connecting the pot seal and cable arrangement to an electrical connector; and, connecting the backshell to the connector in order to force the backshell, cable alignment plate and pot seal into cooperative engagement with the electrical connector.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENTS

Figure 1:
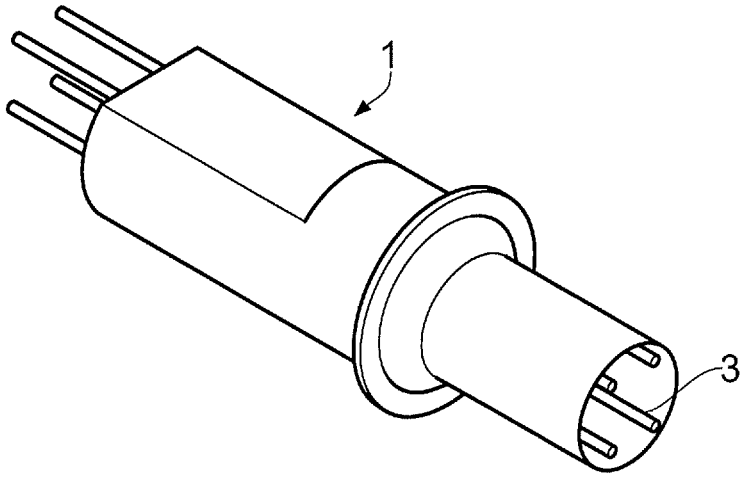
FIG. 1 (Prior Art)
FIG. 1 shows a high speed data bus connector.
Figure 2:
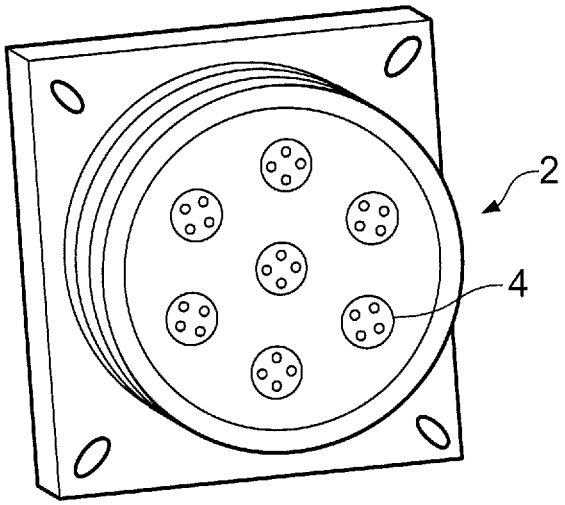
FIG. 2 (Prior Art)
FIG. 2 shows multiple connectors arranged within a larger connector.

FIGS. 1 to 2 show male 1 and female 2 standard connectors respectively, which are most typically used for standard cabling and/or wiring, the male 1 and female 2 standard connectors often containing elastomeric parts at the rear of each connector pair. The inclusion of elastomeric parts at the rear of each connector pair is often to provide a degree of support to the flexible wires, which are often crimped or soldered into the pins 3 and/or sockets 4, thus reducing stress and damage on the connectors. However, the inclusion of elastomeric parts at the rear of each connector pair is often insufficient to prevent damage and ensure longevity of the part.

In particular, it is well known for connectors to provide protection from contamination via an elastomeric or polymeric seal, such seals often being referred to as Environmental Seals, or Triple Ripple Seals where the seal comprises three separate sections. Additionally, an Interfacial Seal may sometimes be placed, in use, between pins 3 and sockets 4. Interfacial seals are typically elastomeric and are so placed to clean the pins 3 before insertion into the sockets 4. In doing so, the purpose of the interfacial seal is to reduce contamination from foreign bodies or debris which may have become attached to the pins 3, the interfacial seals effectively wiping the pins 3 before insertion into and contamination of the sockets 4. In use, wires may be pushed through the elastomeric parts to reduce the ingress of debris, before crimping or soldering to the pins 3 or sockets 4.

Figure 3:
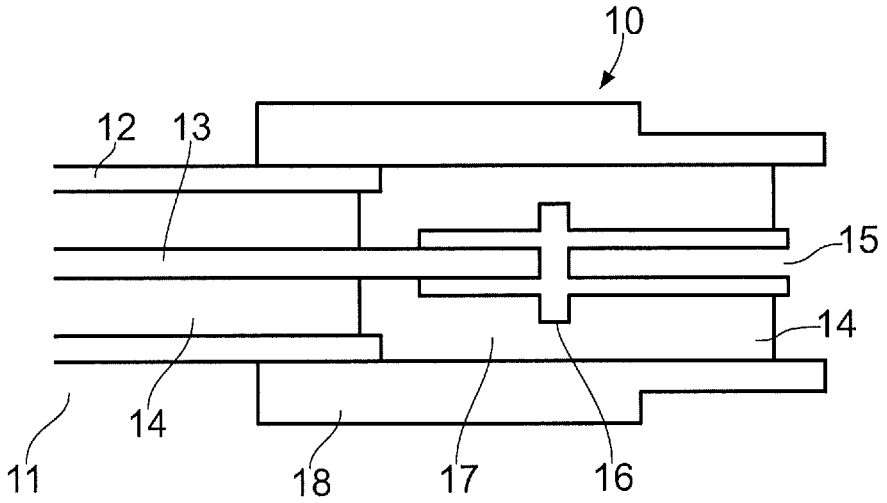
FIG. 3 (Prior Art)
FIG. 3 shows a cross-section through a 'pot seal'.

FIG. 3 shows a cross section through a connector arrangement known as a Pot Seal 10 which is particularly suitable for the connection of minerally insulated (MI) cable 11. As shown in the example arrangement of FIG. 3, a single MI cable 11 is shown as being fed into a pot seal 10. Accordingly, the cable jacket 12 and conductor 13 is shown to be separated by an insulating portion 14, the jacket 12 being typically connected to the Pot 10 by soldering and the conductor 13 being typically connected to a pin or socket 15 by soldering or crimping. In particular, the pot seal casing 18 may be filled with an insulator 14 such as epoxy or glass to electrically isolate the conductor 13 from the pot seal casing 18, whilst also fulfilling the function of orientating and positioning the conductor 13 for further engagement and/or connection. The further connection may be male or female in form—if female the further connection is referred to as a socket 15. If male the further connection is referred to as a pin, both of which may optionally include a shoulder 16 to grant improved mechanical integrity to the pin and/or socket 15.

Referring again to FIG. 3, FIG. 3 shows a female socket 15, the respective socket 15 and pin attachment members being designed to be connected or disconnected as matching pairs to form a connector. In an alternative embodiment, there may be two or more such connectors within a given pot seal 10 arrangement. In particular, if there is more than one connector 15 within the pot seal 10, it is necessary to orientate the two halves to ensure that matching male pin and female sockets 15 engage their respective portions. This would normally be achieved using, for example, a flat on the matching pots or alternate means of socket orientation to ensure that the pins and/or sockets 15 are correctly oriented before being bought into engagement.

Figure 4:
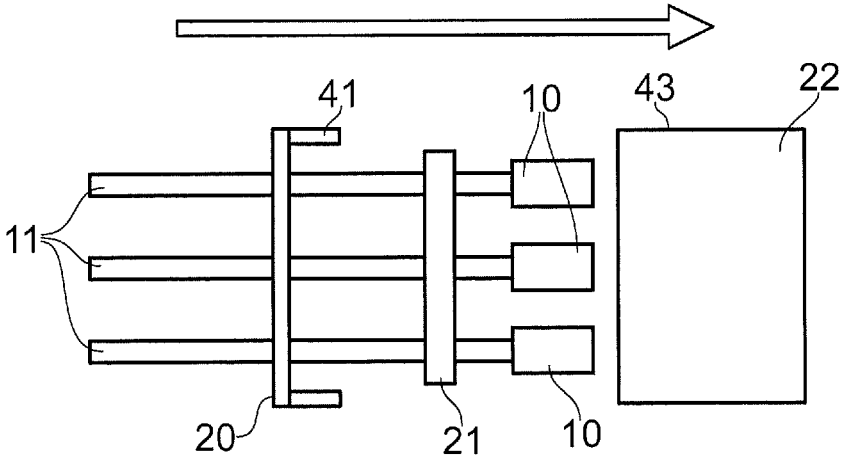
FIG. 4 shows an exploded cross-section of a backshell and cable alignment plate/spacer assembly in accordance with the present disclosure.

FIG. 4 shows an exploded cross-sectional view of a backshell 20 and a spacer 21 assembly in accordance with the present disclosure, wherein either singular or multiple MI cables 11 are, in one embodiment, fed through a back shell 20 and at least one spacer 21, insulating or spacing means before being fed into a pot seal 10. In bringing the male pin and female socket 15 together, the pot seals 10 are further assembled into a connector 22, wherein the pots 10 are receivably held within an insulating portion.

In particular, and in order to accurately locate and provide added support to the pot seals 10, the pot seals 10 are assembled within at least one cable alignment plate or spacer 21, the cable alignment plate being alternatively known as a 'star plate' 31. Alternatively, the cable alignment plate or spacer 21 may also comprise recesses or countersink features such that the pot seals 10 may at least partially locate within or against the cable alignment plate or spacer 21.

Referring again to FIG. 4, during assembly and/or use, cable alignment plate 21 and pot seal 10 arrangement may be received within the backshell 20, which is successively attached or brought into cooperable engagement with the connector 22. As such, in attaching the backshell 20 to the connector 22, the backshell 20 may cooperatively engage the cable alignment plate 21 which, in turn, and through successive tightening, may force each of the pot seals 10 into an engagement with the connector 22.

In an alternative arrangement, the assembly may comprise multiple cable alignment plates 21 arranged to allow varying contact and cable sizes to be accommodated within each of the cable retaining features 32, therefore allowing the compression of one or more seals to improve the environmental sealing of the backshell to the one or more MI cables 10 and connector 22.

Figure 5:
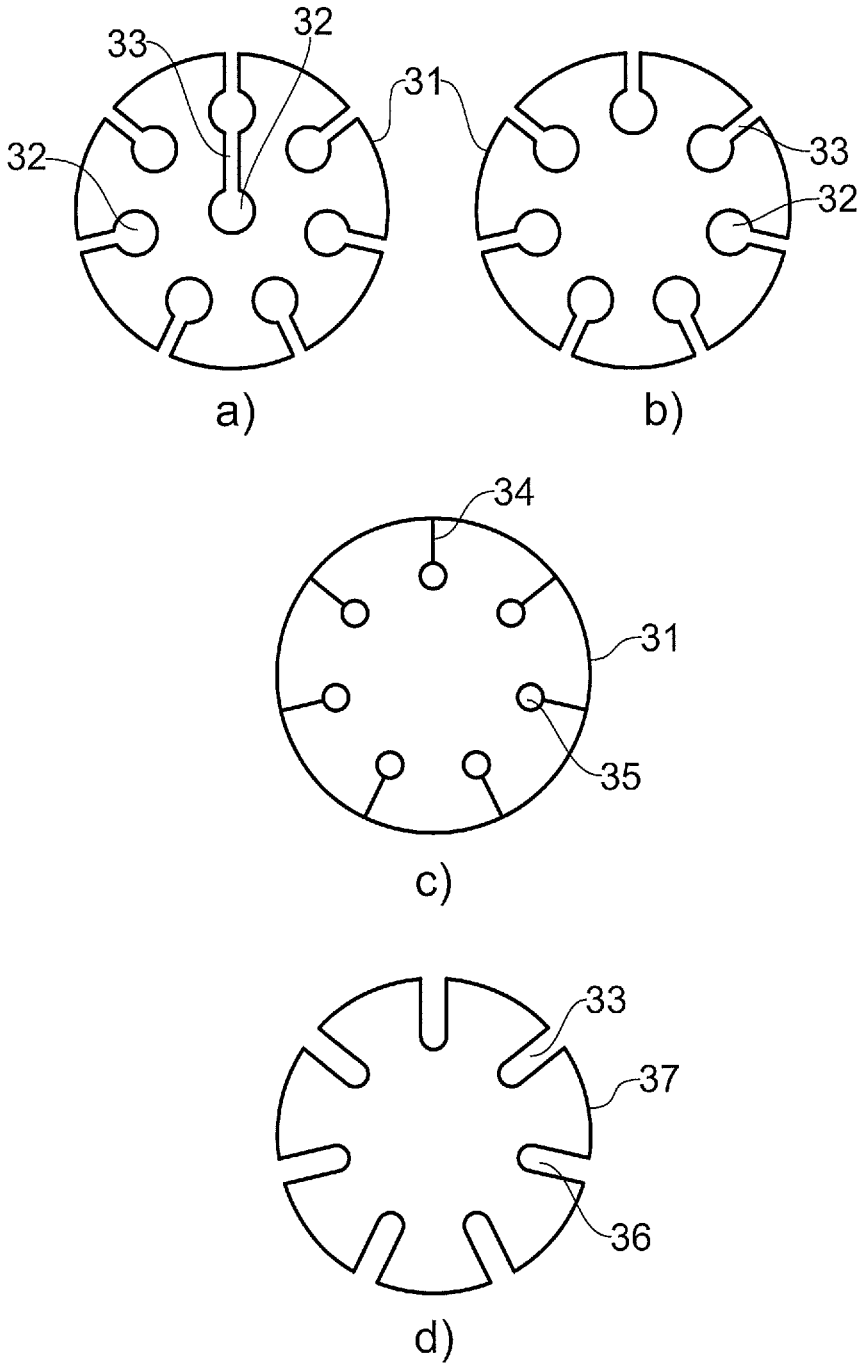
FIG. 5 shows a collection of star plates in accordance with the present disclosure.

In particular, FIG. 5 shows a collection of star plates 31 in accordance with an embodiment of the present invention. In particular, the star plates 31 may comprise one or more cable-retaining features 32, said features including for example, one or more of slots 34, recesses 36, holes 35 or channels 33, or any combination of the same, the retaining features being so placed as to align the cables, in use, with the receiving features of the connector 22. Each star plate 31 may be made of a rigid material such as for example, a metal, but could be alternatively be comprised of a ceramic, composite or polymeric material. It may also be envisaged that any one or more of the plates 31 be optionally comprised of a flexible material such as for example, either of an elastomeric or polymeric material.

Referring again to FIG. 5, each star plate 31 may be one or more of variable shape, thickness and/or material. FIG. 5*a* shows a first star plate 31, the plate being comprised of, for example fluoro-silicone elastomer. In particular, FIG. 5*a* shows a star plate 31 with a series of enlarged recesses comprising multiple channels 33 radially extending towards the centre of the plate 31 and terminating with substantially circular cable-retaining feature 32, which may be so shaped to access used contacts and seal unused locations, or sized to suit for example, a Quadrax contact as part of a further embodiment of the present invention. It will however be appreciated that in a further embodiment, any such polymeric or elastomeric material, or any such flexible material suitable for electrical isolation, may be used. In particular, FIG. 5*a* also shows a channel 33 comprising two or more such cable location features 32 through which the MI cable 11 may be inserted and retained. Accordingly, the star plate 31 of 5*a* provides an additional channel 33 suitable for the location of a further MI cable during use.

Referring again to FIG. 5, it will be appreciated that the cable-retaining features 32 may comprise two or more slots 34, recesses 36, holes 35 or channels 33 of variable sizing, or any combination of the same, through which the MI cable 11 may be inserted and retained. Depending on the type of star plate 31 being used, the slot width of each cable-retaining feature 32 may preferably be at least the diameter of the MI Cable 11 designated for use, thus allowing the selected MI cable 11 to be retained within the designated cable-retaining feature 32. However, it will be appreciated that such cable location features 32 may, in a further embodiment, comprise a hole 35 through which the MI cable 11 may be fed. It may also be appreciated that the width of any slot 34 may be less than the diameter of the MI Cable 11. In such an instance it may be appreciated that the slot width may expand or reduce during and following insertion of the MI cable 11.

FIG. 5*b* shows an alternative arrangement for the first plate 31, wherein a series of enlarged recesses comprising multiple channels 33 radially extending towards the centre of the plate 31 and terminating with substantially circular cable-retaining feature 32.

FIG. 5*c* shows a further plate, the plate being comprised of, for example fluoro-silicone elastomer. In particular, FIG. 5*c* shows a plate with a series of slots 34 radially extending towards the centre of the star plate 31 and terminating with substantially circular cable-retaining feature 32, which is operable, in use, to allow a cushion to close around the inserted MI cable 11 and which may be so shaped to suit the MI cable 11 diameter being used. It will however be appreciated that in a further embodiment, any such polymeric or elastomeric material, or any such flexible material suitable for electrical isolation, may be used.

FIG. 5*d* shows a third plate being so described as a pressure plate 37, the pressure plate 37 being operable in use to compress the fluoro-silicone items onto the connector 22 and around the MI wire 11 and pot seals 10. Furthermore, the pressure plate 37 may be comprised of, for example one or more of metallic, polymeric or composite materials such as PEEK or CF-PEEK. In particular, FIG. 5*d* shows a pressure plate 37 with a series of recesses 36 comprising multiple channels 33 radially extending towards the centre of the pressure plate 37, which may be so shaped to suit the MI cable 11 diameter being used. In an alternative embodiment, a moulded single-piece pressure plate 37 may be used with stepped holes 35 and rotating pressure plates 37 which may be integral to the backshell 20.

Figure 6:
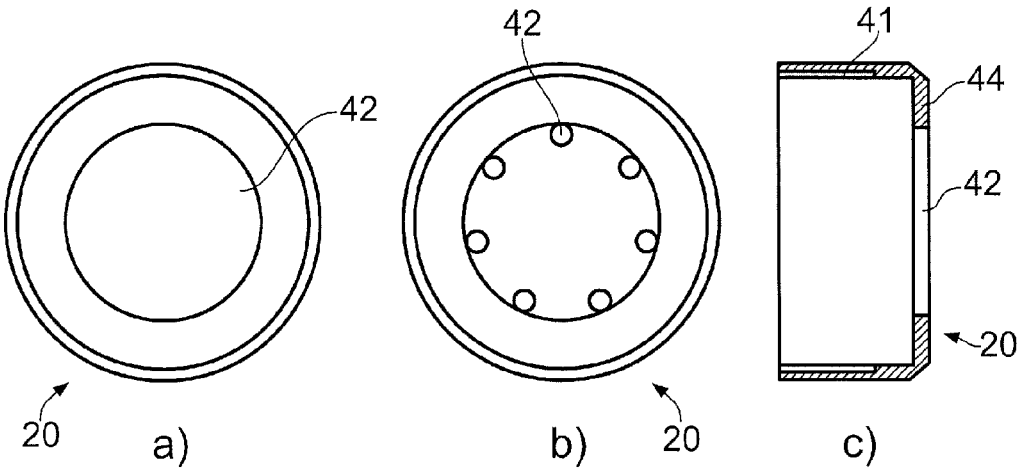
FIG. 6 shows a backshell in accordance with the present disclosure.

FIG. 6*a* shows a frontal view of the backshell 20, described in an embodiment of the present invention. In particular, the backshell 20 may be described as a cover further comprising a means of connection. Such means of connection may include for example, a threaded section 41 for subsequent attachment to the connector 22, which may in one embodiment be a MIL-DTL-38999 Series III connector. It will also be appreciated that in a further embodiment, the threaded section 41 for subsequent attachment to the connector 22 may be replaced by any similar connecting, coupling, joining or attachment means. As shown in both FIGS. 6*a* and 6*b*, 6*b* of which shows a frontal view of the backshell 20 as part of a further embodiment, the backshells 20 comprise one or more lead out sections 42 which allow either single or multiple MI cables 11, to pass through the backshell 20 for subsequent connection to at least one pot seal 10 and/or connector 22. In particular, the diameter of the lead out section 42 may be defined based on the details of the star plates 31 depicted in FIGS. 5*a*, 5*b* and 5*c*—the so called first (FIGS. 5*a*, 5*b*) and second (FIG. 5*c*) plates. As shown in FIG. 6*c*, which shows a cross-section of the backshell represented in FIG. 6*a*, the backshell 20 may be connected to and tightened against the connector body 43 via cooperable screw threads 41, or alternate joining means.

FIG. 6*c* shows a cross-sectional view of the backshell 20 shown in FIGS. 6*a* and 6*b*. In particular, as shown in FIG. 6*c*, during assembly and subsequent fixation of the backshell to the connector via a cooperable means of attachment such as for example a screw thread 41, the lip 44 around the rear of the backshell may cooperate with connector 22 and one or more star plates 31 to apply a compressive load and seal the connector 22, so closing the star plates 31 around the pot seals 10 and MI cables 11.

Figure 7:
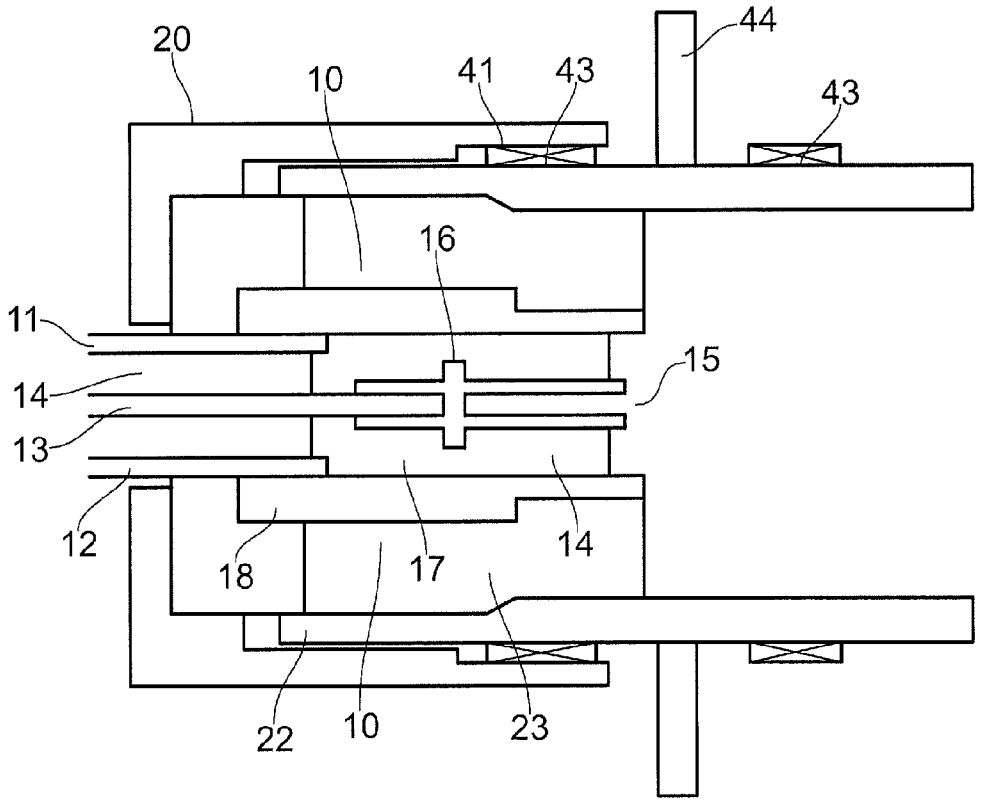
FIG. 7 shows a cross-section of the assembled backshell and star plate assembly in accordance with the present disclosure.

FIG. 7 shows a cross-section of the assembled backshell and star plate assembly, the embodiment comprising a single conductor 13 within the MI cable 11 and a corresponding pot seal 10. In an alternative embodiment, it will be appreciated that there may more typically be a plurality of conductors 13 within the MI cable 11, or a plurality of MI cables 11 as part of a larger assembly, with a corresponding number of pot seals 10 to suit. In such an embodiment, it may also be appreciated that there may be more than one pot seal 10 to suit a corresponding number of MI cables 11. It will also be appreciated that the MI cable 11 herein disclosed as part of the present embodiment is not to be limited to MI cable, but the connector may contain a range of standard cables and/or MI cables known within the art.

Referring again to FIG. 7, FIG. 7 shows a single MI cable 11 comprising a conductor 13, an insulator 14 comprised of an electrical and heat insulating material surrounding the conductor 13, and a cable jacket 12 itself surrounding the conductor 13 and insulator 14 to insulate and protect the MI cable 11. In the present embodiment, and as described in accordance with the embodiment of FIG. 3, the cable jacket 12 and conductors 13 are shown to be separated by an insulating portion 14, the jacket 12 being typically connected to the Pot 10 by soldering, and the conductor 13 being typically connected to a pin or socket 15 by soldering or crimping. Either one of the pin or socket 15 may optionally include a shoulder 16 to provide better structural integrity and/or strength to the pin or socket potting joint 17, although alternative methods of strengthening or increasing rigidity may be envisioned.

As shown in the example arrangement of FIG. 7, a single MI cable 11 is shown as being fed into a pot seal 10. By fully inserting the MI cable 11 into the casing 18, the conductor 13 is engagably received within the further pin or socket 15, which is itself comprised within the pot seal arrangement 10, so establishing an electrical connection between the MI cable 11, Pot Seal 10 and pin or socket 15.

In particular, the pot seal 10 may be filled with an insulator 14 such as epoxy or glass to electrically isolate the conductor 13 from the jacket 12 whilst orientating and positioning the conductor 13 for further engagement and/or connection. As such, the casing 18 is most typically comprised of a metallic material, although use of alternate materials may be envisioned. In a further embodiment, the casing 18 may optionally comprise a cooperable means of alignment such as for example, channels, slots or machined flats which act to align the MI cable 11 prior to or during insertion into the pot seal 10. Additionally, the pin or socket 15, may optionally include a shoulder 16 to provide better structural integrity and/or strength to the pin or socket potting joint 17.

Referring again to FIG. 7, the pot seals are further assembled into a connector 22, wherein the pot seals 10 are receivably held within an insulating material 23 to prevent contact of the pot seal 10 with the connector body 22. Accordingly, the pin or socket 15 is receivebly held within a connector body 22, which itself comprises two or more threads 43 and optionally, a location flange 44. It will be appreciated that in a further embodiment, the threads 43 may be replaced by any similar connecting or joining means.

During assembly, one or more star plates 31 or spacers 21 may be assembled around the MI cable 11 such that the one or more star plates 31 locate against one or more of the connector body 22, pot seal casing 18 and MI cable 11. Accordingly, a backshell 20 is shown to be located over the one or more star plates 31 and connector body 22 so as to connect to the connector body 22. The backshell 20 may be connected to and tightened against the connector body 22 via cooperable screw threads 41,43, although it will be appreciated that in a further embodiment, the threads 41,43 may be replaced by any such connecting, fastening or joining means. As such, in attaching the backshell 20 to the connector body 22, the backshell 20 may cooperatively engage the one or more star plates 31 which, in turn, and through successive tightening, may force the star plates 31 into a cooperative engagement with both the backshell 20 and connector body 22, thus forcing the pot seal casing 18 into cooperative engagement with the insulating material 23 and/or connector body 22.

In particular, the connector arrangement may, in a further embodiment, be used to connect MI cable 11 at one end to standard cable on the matching pair. In this instance, the standard cable end of the connector 22, inclusive of cooperable screw threads 41,43 or any similar connecting or joining means, may optionally contain an additional environmental seal. In a further embodiment, the connector 22 may contain an Interfacial Seal to help keep the pins and sockets 15 clean before interaction with one another. In a further embodiment, there may be no such environmental seals in an MI to MI cable 11 connection as the pots 10 themselves might already be sealed.

The invention claimed is:

1. An electrical connector assembly for the electrical connection of one or more minerally insulated cables (11), the assembly comprising:

a pot seal (10) arranged in use to connect the minerally insulated cable (11) to a connector (22);

at least one cable alignment plate (21); and, a backshell (20) shaped so as to contain the pot seal and cable alignment plate (21);

the cable alignment plate (21,31) and pot seal (10) being arranged so as to locate within the backshell (20) such that in use, connecting the backshell (20) to the connector (22) forces the backshell (20), cable alignment plate (21,31) and pot seal (10) into a cooperative engagement.

2. An assembly according to claim 1 wherein the backshell (20) and connector (22) comprise attachment members arranged to attach the backshell (20) to the connector (22).

3. An assembly according to claim 1 wherein the backshell (20) comprises one or more cable location features (32).

4. An assembly according to claim 3 wherein each cable alignment plate (21,31) comprises one or more cable location features (32).

5. An assembly according to claim 4 wherein the cable location features (32) of the cable alignment plate (21,31) and backshell (20) are aligned in use such that cable (11) passes through the backshell (20) and cable alignment plate (21,31).

6. An assembly according to claim 5 wherein the cable passing through the alignment plate (21,31) and backshell (20) is aligned according to the cable location features (32) of the connector (22).

7. An assembly according to claim 4 wherein the cable location features (32) comprised within the cable alignment plate (21, 31) are shaped so as to at least partially inhibit the withdrawal of the cable from the cable location feature (32).

8. An assembly according to claim 4 wherein the cable location features (32) comprised within the cable alignment plate (21, 31) are shaped so as to support the cable (11) in both a radial and axial direction.

9. An assembly according to claim 1 wherein the connector assembly comprises an environmental seal.

10. An assembly according to claim 1 wherein the connector assembly comprises an interfacial seal.

11. An assembly according to claim 1 wherein the pot seals (10) may locate within shapes, recesses or protrusions within the cable alignment plate (21, 31).

12. An assembly according to claim 1 wherein the connector (22) comprises recesses which resist lateral and axial forces acting on the pot seals (10).

13. An assembly according to claim 1 wherein at least one cable alignment plate (21, 31) is comprised of a substantially flexible elastomeric or polymeric material.

14. An assembly according to claim 1 wherein at least one cable alignment plate (21, 31) is comprised of a substantially rigid elastomeric, polymeric, ceramic or metallic material.

15. A method of electrically connecting a minerally insulated cable (11), the method comprising the steps of:

Passing at least one cable (11) through a backshell (20);

Passing said cable through an alignment plate (21, 31);

Matably receiving said cable (11) within a pot seal arrangement (10);

Connecting the pot seal (10) and cable (11) arrangement to an electrical connector (22); and, Connecting the backshell (20) to the connector (22) in order to force the backshell (20), cable alignment plate (21) and pot seal (10) into cooperative engagement with the electrical connector (22).

* * * * *